US009995490B2

(12) United States Patent
Cadima

(10) Patent No.: US 9,995,490 B2
(45) Date of Patent: Jun. 12, 2018

(54) GAS BURNER ASSEMBLY FOR AN APPLIANCE

(71) Applicant: General Electric Company, Schenectady, NY (US)

(72) Inventor: Paul Bryan Cadima, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 439 days.

(21) Appl. No.: 14/511,291

(22) Filed: Oct. 10, 2014

(65) Prior Publication Data

US 2016/0102866 A1 Apr. 14, 2016

(51) Int. Cl.
*F24C 3/08* (2006.01)
*F23D 14/06* (2006.01)
*F23D 14/58* (2006.01)

(52) U.S. Cl.
CPC ..... *F24C 3/085* (2013.01); *F23D 14/06* (2013.01); *F23D 14/58* (2013.01); *F23D 2900/14064* (2013.01)

(58) Field of Classification Search
CPC ..... F23D 14/06
USPC ..... 126/39 E, 215
See application file for complete search history.

(56) References Cited

U.S. PATENT DOCUMENTS 8,011,358 B2 * 9/2011 Galindo ..... F23D 14/06 126/39 E
8,978,637 B2 * 3/2015 Ryu ..... F23D 14/06 126/39 K
2005/0142511 A1 * 6/2005 Yam ..... F23D 14/06 431/285
2006/0081237 A1 * 4/2006 Chung ..... F23D 14/045 126/39 E
2007/0068505 A1 * 3/2007 Cadima ..... F24C 3/027 126/39 E
2008/0202495 A1 * 8/2008 Caloca Galindo ..... F23D 14/58 126/39 E
2010/0104992 A1 * 4/2010 Padgett ..... F23D 14/06 431/202
2010/0242944 A1 * 9/2010 Richardson ..... A47J 37/0713 126/25 B
2010/0263657 A1 * 10/2010 Ryu ..... F24C 3/085 126/39 E
2010/0263658 A1 * 10/2010 Ryu ..... F24C 3/085 126/39 E
2014/0076303 A1 * 3/2014 Fogolin ..... F24C 3/085 126/39 E (Continued)

FOREIGN PATENT DOCUMENTS

JP 3730114 B2 12/2005

*Primary Examiner* — Avinash Savani
*Assistant Examiner* — Aaron Heyamoto
(74) *Attorney, Agent, or Firm* — Dority & Manning, P.A.

(57) ABSTRACT

A gas burner assembly includes an elongated burner and a round burner positioned at a middle portion of the elongated burner. The elongated burner defines a plurality of flame ports adjacent a first end portion of the elongated burner. Flame ports of the plurality of flame ports that are positioned on a pair of parallel linear segments of the elongated burner have a first total port area, and flame ports of the plurality of flame ports that are positioned on an arcuate segment of the elongated burner have a second total port area. The second total port area is greater than the first total port area.

14 Claims, 4 Drawing Sheets

(56) References Cited

U.S. PATENT DOCUMENTS

| | | | | |
|---|---|---|---|---|
| 2014/0230803 | A1* | 8/2014 | Amati | F23D 14/105 126/39 E |
| 2015/0144123 | A1* | 5/2015 | Cadima | F24C 3/126 126/39 R |
| 2015/0323191 | A1* | 11/2015 | Yang | F24C 3/12 126/42 |
| 2016/0025347 | A1* | 1/2016 | Cadima | F23D 14/06 126/39 E |
| 2016/0025348 | A1* | 1/2016 | Cadima | F24C 3/085 126/39 E |
| 2016/0033139 | A1* | 2/2016 | Cadima | F23D 14/06 126/39 E |
| 2016/0091210 | A1* | 3/2016 | Ceccoli | F24C 15/107 126/216 |

* cited by examiner

GAS BURNER ASSEMBLY FOR AN APPLIANCE

FIELD OF THE INVENTION

The present subject matter relates generally to gas burner assemblies for appliances, such as gas range appliances or gas cooktop appliances.

BACKGROUND OF THE INVENTION

Range appliances generally include a cooktop portion and an oven portion. The cooktop portion of certain range appliances includes a griddle burner for heating large cookware, such as griddles and fish poachers. Griddle burners provide flame ports along a length of the griddle burner in order to heat large cookware on the cooktop portion.

Evenly heating large cookware with griddle burners can be difficult due to uneven temperature distributions along a length of the griddle burners. Because the griddle burners are not as long as the griddle, the griddle tends to be hotter at its center and cooler at its ends. If the griddle burner were longer in an effort to offset this effect, the manufacturing cost of the griddle burner would increase accordingly. Furthermore, a minimum firing rate that the griddle burner could support would increase due to the increased perimeter of the griddle burner, thereby increasing a heat output of the griddle burner at its minimum setting. Finally, the extra length could cause the griddle burner to be longer than common cookware, including typical fish poachers, thereby reducing the versatility of the griddle burner as it would no longer be suitable for such cookware.

Accordingly, a burner assembly with features for assisting with heating a griddle and cookware smaller than a griddle would be useful. In particular, a burner assembly with features for assisting with uniformly heating a griddle and uniformly heating cookware smaller than a griddle would be useful.

BRIEF DESCRIPTION OF THE INVENTION

The present subject matter provides a gas burner assembly. The gas burner assembly includes an elongated burner and a round burner positioned at a middle portion of the elongated burner. The elongated burner defines a plurality of flame ports adjacent a first end portion of the elongated burner. The flame ports of the plurality of flame ports that are positioned on a pair of parallel linear segments of the elongated burner have a first total port area. The flame ports of the plurality of flame ports that are positioned on an arcuate segment of the elongated burner have a second total port area. The second total port area is greater than the first total port area. Additional aspects and advantages of the invention will be set forth in part in the following description, or may be apparent from the description, or may be learned through practice of the invention.

In a first exemplary embodiment, a gas burner assembly is provided. The gas burner assembly includes an elongated burner extending between a first end portion and a second end portion. The elongated burner defines a first plurality of flame ports adjacent the first end portion of the elongated burner and a second plurality of flame ports adjacent the second end portion of the elongated burner. The first plurality of flame ports are distributed along a pair of parallel linear segments of the elongated burner and an arcuate segment of the elongated burner that extends between the linear segments of the pair of linear segments. The flame ports of the first plurality of flame ports positioned on the pair of parallel linear segments have a first total port area. The flame ports of the first plurality of flame ports positioned on the arcuate segment have a second total port area. The second total port area is greater than the first total port area. The gas burner assembly also includes a round burner positioned at a middle portion of the elongated burner.

In a second exemplary embodiment, a gas burner assembly is provided. The gas burner assembly includes a round burner and an elongated burner. The elongated burner has a first elongated burner portion and a second elongated burner positioned opposite each other about the round burner. The first elongated burner portion has a pair of linear edges and an arcuate edge that extends between the linear edges of the pair of linear edges. The first elongated burner portion also defines a first plurality of flame ports distributed along the pair of linear edges and the arcuate edge. The flame ports of the first plurality of flame ports that are positioned at the pair of linear edges have a first total port area. The flame ports of the first plurality of flame ports that are positioned at the arcuate edge have a second total port area. The second total port area is greater than the first total port area.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
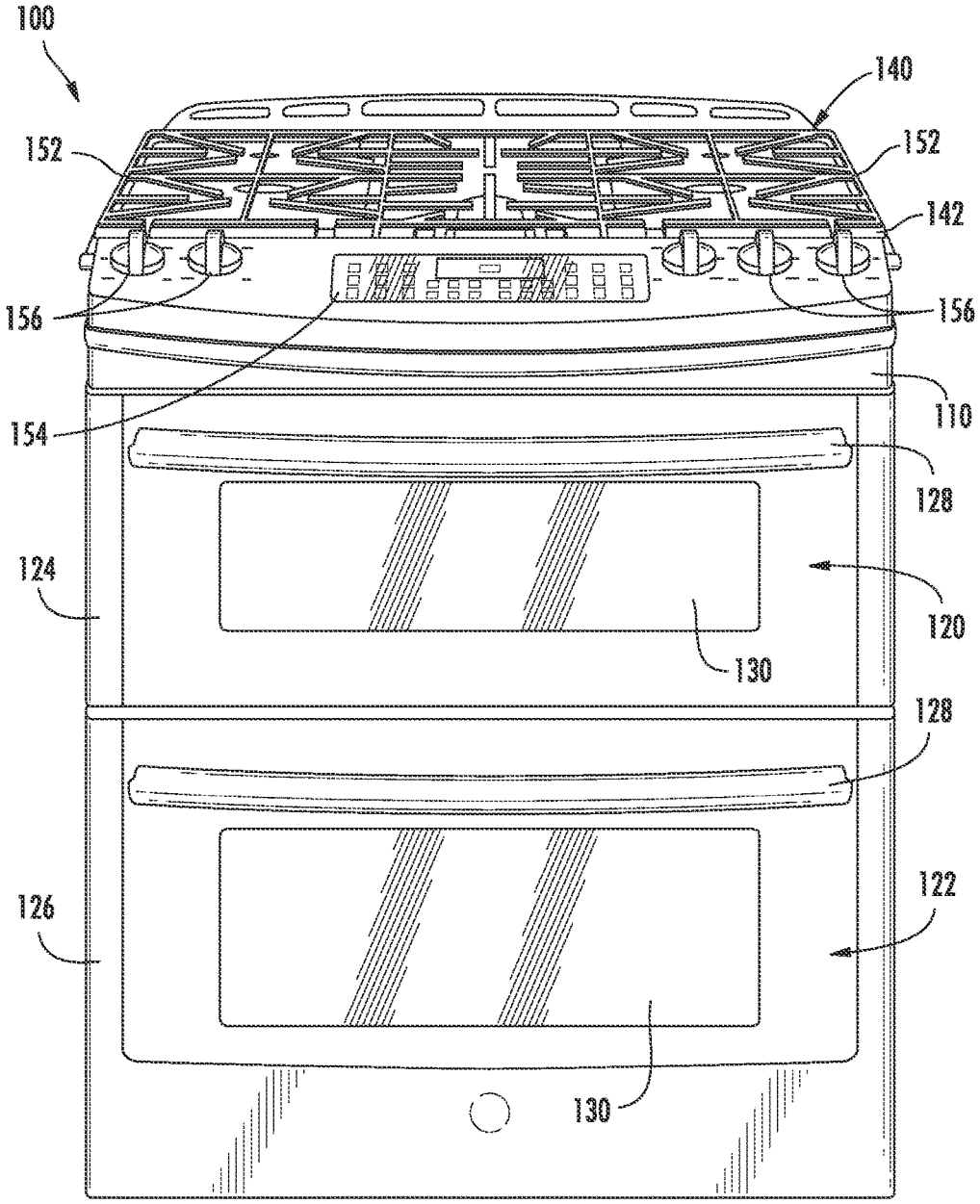
FIG. 1 provides a front, perspective view of a range appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
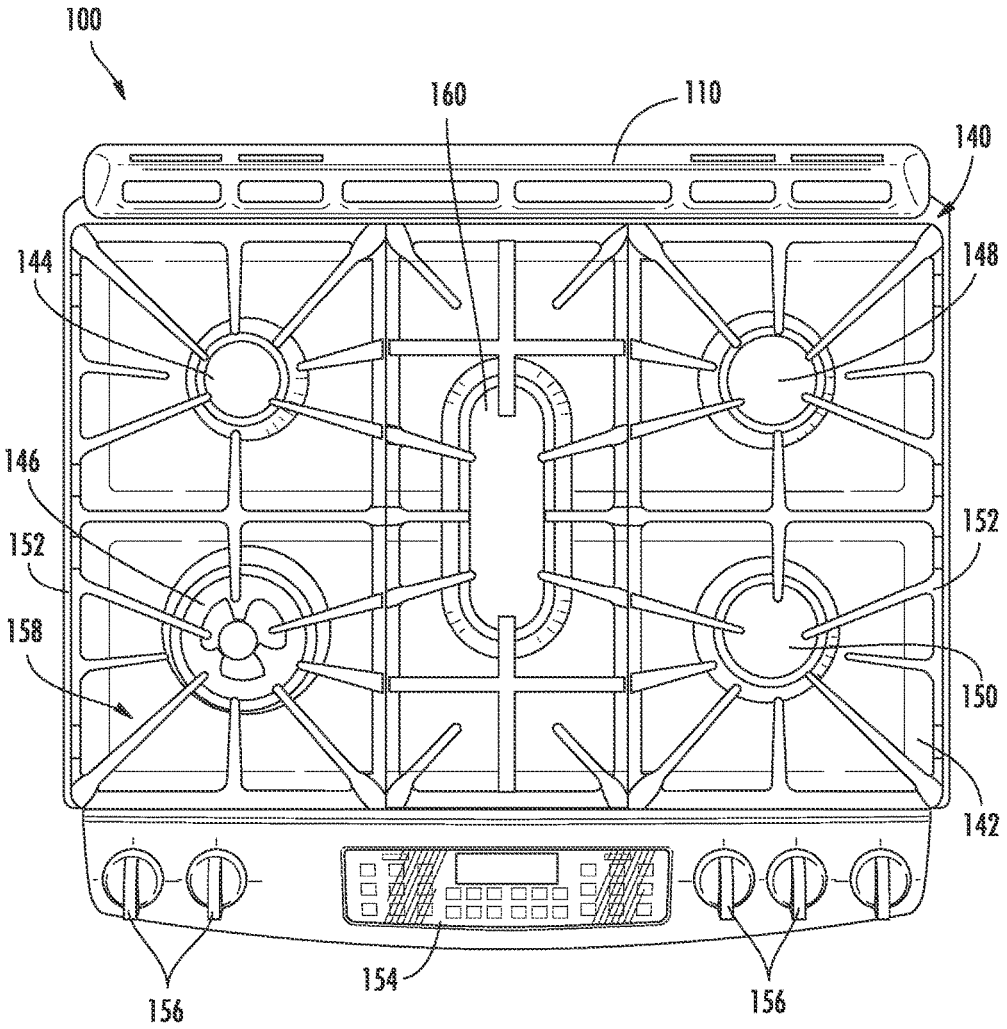
FIG. 2 provides a top, plan view of the exemplary range appliance of FIG. 1 and a burner assembly of the exemplary range appliance.

FIG. 1 provides a front, perspective view of a range appliance 100 as may be employed with the present subject matter. FIG. 2 provides a top, plan view of range appliance 100. Range appliance 100 includes an insulated cabinet 110.

Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable appliance, e.g., a single oven range appliance or a standalone cooktop appliance. Thus, the exemplary embodiment shown in FIG. 1 is not intended to limit the present subject matter to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Figure 3:
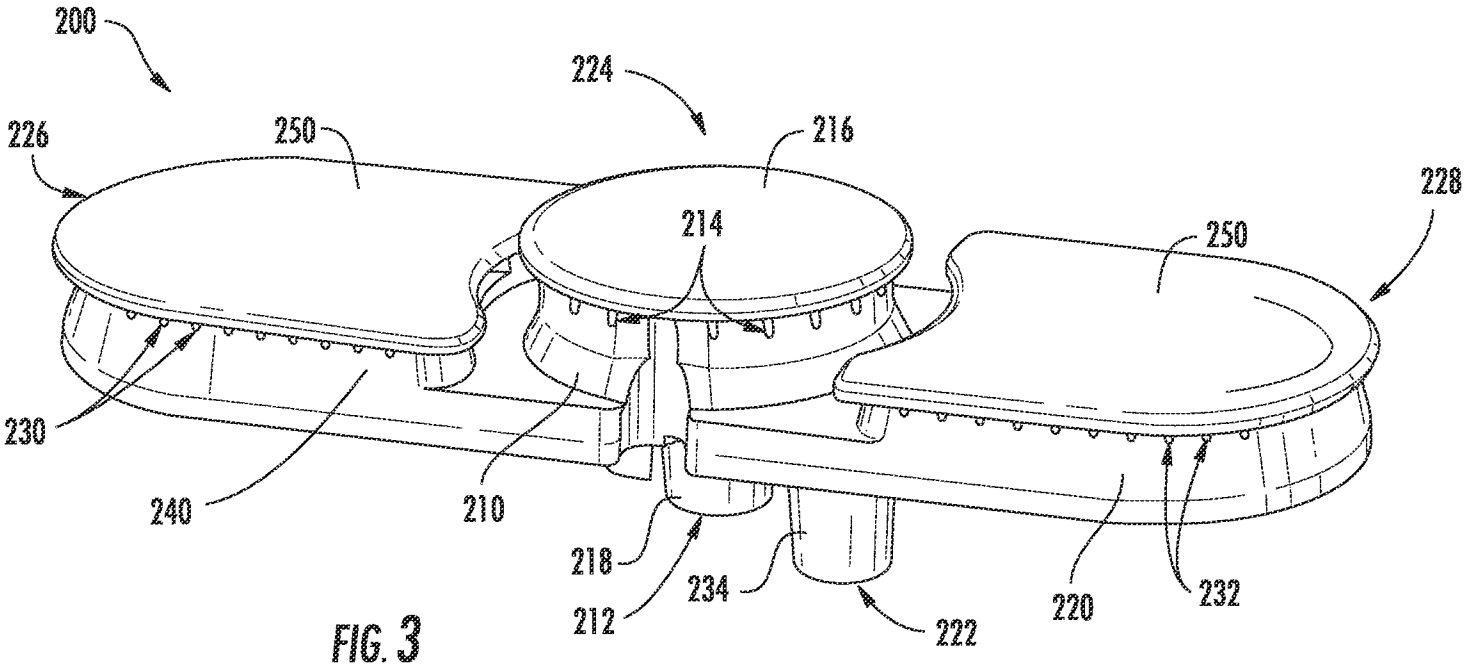
FIG. 3 provides a perspective view of a burner assembly according to an exemplary embodiment of the present subject matter.

FIG. 3 provides a perspective view of a burner assembly 200 according to an exemplary embodiment of the present subject matter. Burner assembly 200 may be used in any suitable appliance. For example, burner assembly 200 may be used in range appliance 100 (FIG. 2) as griddle burner 160. Burner assembly 200 includes features for assisting with heating large cookware, such as griddles, as well as smaller cookware, such as round pots. Burner assembly 200 is discussed in greater detail below.

As may be seen in FIG. 3, burner assembly 200 includes a round burner 210 and an elongated burner 220. During operation of burner assembly 200, a user may utilize only round burner 210 or both round burner 210 and elongated burner 220. As an example, the user may heat a round pot with just round burner 210 in a first heating mode. As another example, the user may heat a griddle or fish poacher with both round burner 210 and elongated burner 220 in a second heating mode. Such selective operation of round burner 210 and elongated burner 220 assist the user with heating variously sized articles uniformly and/or evenly.

Round burner 210 includes a fuel inlet 212 and a plurality of flame ports 214. Flame ports 214 may be distributed or dispersed in a circular pattern or shape, e.g., in plane that is perpendicular to a vertical direction. Gaseous fuel, such as natural gas or propane, may flow into round burner 210 via or through fuel inlet 212 of round burner 210. The gaseous fuel may flow out of round burner 210 and be combusted at flame ports 214 of round burner 210. Round burner 210 also includes a cover plate 216 positioned over flame ports 214 of round burner 210. Fuel inlet 212 of round burner 210 includes a Venturi mixing tube 218 that assists with mixing gaseous fuel flowing into round burner 210, e.g., with air, in order to assist combustion of the gaseous fuel at flame ports 214 of round burner 210. Round burner 210 may be positioned or disposed at any suitable location on burner assembly 200. For example, round burner 210 may be positioned at a middle portion 224 of elongated burner 220.

Elongated burner 220 extends, e.g., linearly, between a first end portion 226 and a second end portion 228. Thus, first and second end portions 226, 228 of elongated burner 220 are spaced apart from each other. Round burner 210 (and middle portion 224 of elongated burner 220) may be positioned between first and second end portions 226, 228 of elongated burner 220. Elongated burner 220 also defines a first burner or plurality of flame ports 230 and a second burner or plurality of flame ports 232. First plurality of flame ports 230 is positioned at or adjacent first end portion 226 of elongated burner 220. Conversely, second plurality of flame ports 232 is positioned at or adjacent second end portion 228 of elongated burner 220. First and second pluralities of flame ports 230, 232 may be distributed or dispersed in a U pattern or shape, e.g., in plane that is perpendicular to a vertical direction, at first and second end portions 226, 228 of elongated burner 220, respectively. Each flame port of first plurality of flame ports 230 may be substantially (e.g., within five percent of) uniformly sized in cross-sectional area, and each flame port of first plurality of flame ports 230 may be substantially (e.g., within five percent of) uniformly sized in cross-sectional area.

Like round burner 210, elongated burner 220 also has a fuel inlet 222. Gaseous fuel, such as natural gas or propane, may flow into elongated burner 220 via or through fuel inlet 222 of elongated burner 220. Gaseous fuel from fuel inlet 222 of elongated burner 220 may flow to first and second pluralities of flame ports 230, 232. Thus, first and second pluralities of flame ports 230, 232 are in fluid communication with fuel inlet 222 of elongated burner 220 via a fuel chamber 244 (FIG. 4), e.g., due to fuel chamber 244 extending between first and second pluralities of flame ports 230, 232 within elongated burner 220. At first and second pluralities of flame ports 230, 232, the gaseous fuel may be combusted in order to heat cookware and food items therein.

Elongated burner 220 further includes a pair of cover plates 250. A first one of cover plates 250 is positioned at first end portion 226 of burner base 240 over first plurality of flame ports 230, and a second one of cover plates 250 is positioned at second end portion 228 of burner base 240 over second plurality of flame ports 232. As may be seen in FIG. 3, fuel inlet 222 of elongated burner 220 includes a Venturi mixing tube 234. Venturi mixing tube 234 assists with mixing gaseous fuel flowing into elongated burner 220, e.g., with air, in order to assist combustion of the gaseous fuel at first and second pluralities of flame ports 230, 232 of elongated burner 220.

A burner base 240 may define both round burner 210 and elongated burner 220. Thus, round burner 210 and elongated burner 220 may be formed from a single integral or continuous piece of material, such as aluminum alloy. It should be understood that, in alternative exemplary embodiments, round burner 210 and elongated burner 220 may be formed from separate or discrete piece of material that are mounted or secured to each other.

Figure 4:
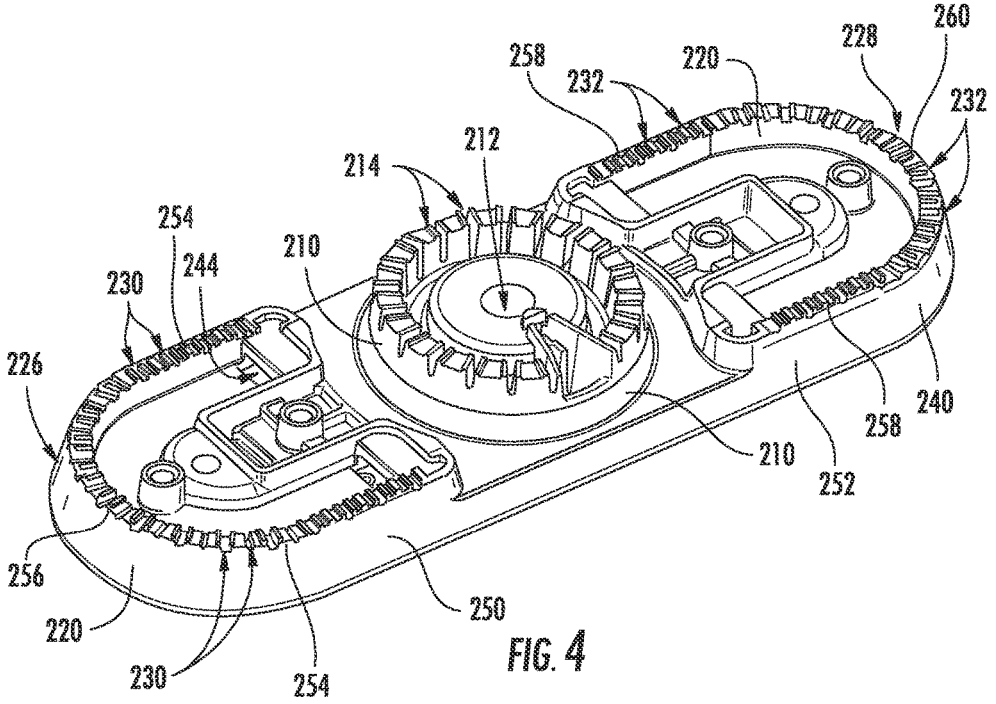
FIG. 4 provides a perspective view of a burner base of the exemplary burner assembly of FIG. 3.

FIG. 4 provides a perspective view of burner base 240 of burner assembly 200. As may be seen in FIG. 4, elongated burner 220 includes a first elongated burner portion 250 positioned at or adjacent first end portion 226 of elongated burner 220 and a second elongated burner portion 252 positioned at or adjacent second end portion 228 of elongated burner 220. Thus, first and second elongated burner portions 250, 252 may be spaced apart from each other, and round burner 210 may be disposed between first and second elongated burner portions 250, 252.

First elongated burner portion 250 includes a first pair of parallel linear edges or segments 254 and a first arcuate edge or segment 256. First arcuate segment 256 extends between and connects the linear segments of first pair of parallel linear segments 254. In particular, first arcuate segment 256 is positioned at first end portion 226 of elongated burner 220, and linear segments of the first pair of parallel linear segments 254 extend from first arcuate segment 256 towards round burner 210. First arcuate segment 256 may connect with linear segments of the first pair of parallel linear segments 254 at respective tangent points between the curved and linear edges.

Flame ports of first plurality of flame ports 230 are distributed along the linear segments of first pair of parallel linear segments 254 and first arcuate segment 256 of first elongated burner portion 250. Flame ports of first plurality of flame ports 230 that are positioned on or at the linear segments of the first pair of parallel linear segments 254 have a first total port area. Conversely, flame ports of first plurality of flame ports 230 that are positioned on or at first arcuate segment 256 have a second total port area. The second total port area is greater than the first total port area. For example, the second total port area may be at least one and one half times greater than the first total port area.

In order to provide burner assembly 200 with the second total port area greater than the first total port area, various configurations are available. For example, a number of flame ports of first plurality of flame ports 230 that are positioned on or at the linear segments of the first pair of parallel linear segments 254 may be greater than a number of flame ports of first plurality of flame ports 230 that are positioned on or at first arcuate segment 256, e.g., if first plurality of flame ports 230 are equally or uniformly sized. As another example, flame ports of first plurality of flame ports 230 that are positioned on or at first arcuate segment 256 may be larger in cross-sectional area than that of flame ports of first plurality of flame ports 230 that are positioned on or at the linear segments of the first pair of parallel linear segments 254. Such distribution and/or sizing of flame ports of first plurality of flame ports 230 may assist with biasing heating of cookware with burner assembly 200 towards first end portion 226 of elongated burner 220. Thus, the cookware may be heated more evenly with burner assembly 200.

Second elongated burner portion 252 includes a second pair of parallel linear edges or segments 258 and a second arcuate edge or segment 260. Second arcuate segment 260 extends between and connects the linear segments of second pair of parallel linear segments 258. In particular, second arcuate segment 260 is positioned at second end portion 228 of elongated burner 220, and linear segments of the second pair of parallel linear segments 258 extend from second arcuate segment 260 towards round burner 210. Second arcuate segment 260 may connect with linear segments of the second pair of parallel linear segments 258 at respective tangent points between the curved and linear edges.

Flame ports of second plurality of flame ports 232 are distributed along the linear segments of second pair of parallel linear segments 258 and second arcuate segment 260 of second elongated burner portion 252. Flame ports of second plurality of flame ports 232 that are positioned on or at the linear segments of the second pair of parallel linear segments 258 have a third total port area. Conversely, flame ports of second plurality of flame ports 232 that are positioned on or at second arcuate segment 260 have a fourth total port area. The fourth total port area is greater than the third total port area. For example, the fourth total port area may be at least one and one half times greater than the third total port area.

In order to provide burner assembly 200 with the fourth total port area greater than the third total port area, various configurations are available. For example, a number of flame ports of second plurality of flame ports 232 that are positioned on or at the linear segments of the second pair of parallel linear segments 258 may be greater than a number of flame ports of second plurality of flame ports 232 that are positioned on or at second arcuate segment 260, e.g., if second plurality of flame ports 232 are equally or uniformly sized. As another example, flame ports of second plurality of flame ports 232 that are positioned on or at second arcuate segment 260 may be larger in cross-sectional area than that of flame ports of second plurality of flame ports 232 that are positioned on or at the linear segments of the second pair of parallel linear segments 258. Such distribution and/or sizing of flame ports of second plurality of flame ports 232 may assist with biasing heating of cookware with burner assembly 200 towards second end portion 228 of elongated burner 220. Thus, the cookware may be heated more evenly with burner assembly 200.

To further assist uniform heating of cookware with burner assembly 200, first and second pluralities of flame ports 230, 232 may be angled towards a respective one of first and second end portions 226, 228 of elongated burner 220. In particular, first and second end portions 226, 228 may be angled in the same or similar manner to flame ports of the elongated burner described in U.S. patent application Ser. No. 14/466,655 of Paul Bryan Cadima, which is hereby incorporated by reference for all purposes. Thus, flame ports of first plurality of flame ports 230 that are positioned on or at the linear segments of the first pair of parallel linear segments 254 may be angled towards first end portion 226 of elongated burner 220. In particular, each flame ports of first plurality of flame ports 230 that is positioned on or at the linear segments of the first pair of parallel linear segments 254 may define an angle with the minor axis of elongated burner 220, with the angle being greater than twenty degrees and less than sixty degrees. The flame ports of second plurality of flame ports 232 that are positioned on or at the linear segments of the second pair of parallel linear segments 258 may be similarly angled towards second end portion 228 of elongated burner 220. Such angling of first and second pluralities of flame ports 230, 232 may assist with heating cookware more evenly with burner assembly 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly, comprising:

an elongated burner extending between a first end portion and a second end portion, the elongated burner comprising a first plurality of flame ports adjacent the first end portion of the elongated burner and a second plurality of flame ports adjacent the second end portion of the elongated burner, the first plurality of flame ports distributed along a pair of parallel linear segments of the elongated burner and an arcuate segment of the elongated burner that extends between the linear segments of the pair of linear segments, the flame ports of the first plurality of flame ports on the pair of parallel linear segments having a first total port area, the flame ports of the first plurality of flame ports on the arcuate segment having a second total port area, the second total port area being greater than the first total port area; and a round burner positioned at a middle portion of the elongated burner, wherein the second total port area is at least one and one half times greater than the first total port area, wherein the first and second end portions of the elongated burner are positioned opposite each other about the round burner, wherein a number of flame ports of the first plurality of flame ports on the pair of parallel linear segments is greater than a number of flame ports of the first plurality of flame ports on the arcuate segment, and wherein the arcuate segment connects with each of the pair of linear segments at respective tangent points between curved and linear edges of the elongated burner.

2. The gas burner assembly of claim 1, wherein the pair of parallel linear segments is a first pair of parallel linear segments and the arcuate segment is a first arcuate segment, the second plurality of flame ports distributed along a second pair of parallel linear segments of the elongated burner and a second arcuate segment of the elongated burner that extends between the linear segments of the second pair of linear segments, the flame ports of the second plurality of flame ports on the second pair of parallel linear segments having a third total port area, the flame ports of the second plurality of flame ports on the second arcuate segment having a fourth total port area, the fourth total port area being greater than the third total port area.

3. The gas burner assembly of claim 2, wherein the fourth total port area is at least one and one half times greater than the third total port area.

4. The gas burner assembly of claim 1, wherein the arcuate segment is positioned at the first end portion of the elongated burner, the linear segments of the pair of parallel linear segments extending from the arcuate segment towards the round burner.

5. The gas burner assembly of claim 1, further comprising a pair of cover plates, each cover plate of the pair of cover plates positioned over a respective one of the first and second pluralities of flame ports.

6. The gas burner assembly of claim 1, wherein the flame ports of the first plurality of flame ports on the arcuate segment are larger in cross-sectional area than that of the flame ports of the first plurality of flame ports on the pair of parallel linear segments.

7. The gas burner assembly of claim 1, wherein the elongated burner and the round burner are defined by a single continuous piece of metal.

8. A gas burner assembly, comprising:

a round burner;

an elongated burner having a first elongated burner portion and a second elongated burner positioned opposite each other about the round burner, the first elongated burner portion having a pair of linear edges and an arcuate edge that extends between the linear edges of the pair of linear edges, the first elongated burner portion also comprising a first plurality of flame ports distributed along the pair of linear edges and the arcuate edge, the flame ports of the first plurality of flame ports positioned at the pair of linear edges having a first total port area, the flame ports of the first plurality of flame ports positioned at the arcuate edge having a second total port area, the second total port area being greater than the first total port area, wherein the second total port area is at least one and one half times greater than the first total port area, wherein a number of flame ports of the first plurality of flame ports on the pair of parallel linear segments is greater than a number of flame ports of the first plurality of flame ports on the arcuate segment, and wherein the arcuate segment connects with each of the pair of linear segments at respective tangent points between curved and linear edges of the elongated burner.

9. The gas burner assembly of claim 8, wherein the pair of linear edges is a first pair of linear edges and the arcuate edge is a first arcuate edge, the second elongated burner portion having a second pair of linear edges and a second arcuate edge that extends between the linear edges of the second pair of linear edges, the second elongated burner portion also comprising a second plurality of flame ports distributed along the second pair of linear edges and the second arcuate edge, the flame ports of the second plurality of flame ports positioned at the second pair of linear edges having a third total port area, the flame ports of the second plurality of flame ports positioned at the second arcuate edge having a fourth total port area, the fourth total port area being greater than the third total port area.

10. The gas burner assembly of claim 9, wherein the fourth total port area is at least one and one half times greater than the third total port area.

11. The gas burner assembly of claim 9, wherein the elongated burner extends between a first end portion and a second end portion, the first arcuate edge positioned at the first end portion of the elongated burner, the edges of the first pair of linear edges extending from the first arcuate edge towards the round burner, the second arcuate edge positioned at the second end portion of the elongated burner, the edges of the second pair of linear edges extending from the second arcuate edge towards the round burner.

12. The gas burner assembly of claim 8, further comprising a pair of cover plates, each cover plate of the pair of cover plates positioned over a respective one of the first and second elongated burner portions.

13. The gas burner assembly of claim 8, wherein each flame port of the first plurality of flame ports positioned at the arcuate edge is larger in cross-sectional area than each flame port of the first plurality of flame ports positioned at the pair of linear edges.

14. The gas burner assembly of claim 8, wherein the elongated burner and the round burner are defined by a single continuous piece of metal.

* * * * *